US007111772B2

(12) United States Patent
MacNeill

(10) Patent No.: US 7,111,772 B2
(45) Date of Patent: Sep. 26, 2006

(54) DECORATIVE MAILBOX

(76) Inventor: Stuart J. MacNeill, 4 Ella Woods Dr., Kittery, ME (US) 03904

( * ) Notice: Subject to any disclaimer, the term of this patent is extended or adjusted under 35 U.S.C. 154(b) by 0 days.

(21) Appl. No.: 11/271,820

(22) Filed: Nov. 14, 2005

(65) Prior Publication Data

US 2006/0131373 A1 Jun. 22, 2006

Related U.S. Application Data

(60) Provisional application No. 60/636,539, filed on Dec. 17, 2004.

(51) Int. Cl.
*B65G 11/04* (2006.01)

(52) U.S. Cl. ..... 232/45; 232/28; 232/38

(58) Field of Classification Search ..... 232/28, 232/19, 45, 29, 33, 38; D99/29–32; 220/831, 220/832

See application file for complete search history.

(56) References Cited

U.S. PATENT DOCUMENTS

| | | | | | |
|---|---|---|---|---|---|
| 584,137 | A | | 6/1897 | Willinger | |
| 672,518 | A | * | 4/1901 | Wright | 232/17 |
| 676,431 | A | * | 6/1901 | Giere | 232/25 |
| 676,913 | A | * | 6/1901 | Randall | 232/25 |
| 728,401 | A | * | 5/1903 | Langford | 232/24 |
| 736,815 | A | * | 8/1903 | Brown | 232/17 |
| 747,820 | A | * | 12/1903 | Wilson | 232/45 |
| 1,204,494 | A | * | 11/1916 | Sare | 232/45 |
| 1,334,908 | A | * | 3/1920 | Kinzel | 220/832 |
| 1,839,834 | A | * | 1/1932 | Coleman | 232/28 |
| 2,192,445 | A | * | 3/1940 | Lau | 232/17 |
| 2,552,628 | A | | 5/1951 | Gallaher | |
| 2,561,007 | A | * | 7/1951 | Bierig | 232/17 |
| 3,946,939 | A | * | 3/1976 | Schifman | 232/17 |
| D248,580 | S | | 7/1978 | Luttrell | |
| 4,650,113 | A | | 3/1987 | Hunt | |
| D346,266 | S | | 4/1994 | Tingler | |
| D347,927 | S | | 6/1994 | Martin | |
| D371,888 | S | | 7/1996 | Tingler | |
| 5,597,116 | A | | 1/1997 | Morris | |
| D411,110 | S | | 6/1999 | Kangas | |
| D411,906 | S | | 7/1999 | Ely | |
| D413,422 | S | | 8/1999 | Colbert | |
| D417,058 | S | | 11/1999 | Royal | |
| D418,272 | S | | 12/1999 | Hiott | |
| D426,934 | S | | 6/2000 | Powell | |
| 6,109,519 | A | | 8/2000 | McClure | |
| D440,026 | S | | 4/2001 | Barney | |
| D441,171 | S | | 4/2001 | Vergakis | |
| D443,401 | S | | 6/2001 | Arnold | |
| D454,243 | S | | 3/2002 | Pawlowski | |
| D472,032 | S | | 3/2003 | Young | |
| 6,533,167 | B1 | | 3/2003 | Hassan | |
| D477,704 | S | | 7/2003 | Thomas | |
| D488,909 | S | | 4/2004 | Burns | |

* cited by examiner

FOREIGN PATENT DOCUMENTS

| | | |
|---|---|---|
| WO | WO99/10255 | 3/1999 |

*Primary Examiner*—William L. Miller
(74) *Attorney, Agent, or Firm*—Richard C. Litman

(57) ABSTRACT

The decorative mailbox is of two-piece design, having a lower portion and an upper portion. The lower portion is a box-like receptacle adapted to receive and contain mail items therein. The upper portion is designed in the shape of a motor vehicle. The vehicle may be of any make and/or model. NASCAR vehicles, trucks and sports cars would probably be desirable. The upper portion is hinged to the lower portion at their respective rear ends in a manner that allows the upper portion to be pivoted upward. A ratchet mechanism allows the upper portion to remain stationary in at least two raised positions. A snap mechanism is disposed at the front ends of the two portions to retain the upper portion in a closed position when desired.

6 Claims, 5 Drawing Sheets

DECORATIVE MAILBOX

CROSS-REFERENCE TO RELATED APPLICATION

This application claims the benefit of U.S. Provisional Patent Application Ser. No. 60/636,539, filed Dec. 17, 2004.

BACKGROUND OF THE INVENTION

1. Field of the Invention

The present invention generally relates to receptacles. More specifically, the present invention is drawn to a decorative mailbox designed to simulate a motor vehicle.

2. Description of the Related Art

There are many automobile aficionados who relish any item that reminds them of a favored automotive vehicle. Replicas of sport cars, trucks, NASCAR vehicles, etc. are represented in paintings, jewelry, rearview mirror hangings and the like. The simulated replicas are proudly worn or exhibited by their owners. It is evident that similar replicas would certainly be appreciated in other utilitarian forms. One such form is that of a mailbox. Decorative mailboxes are known in the art, some of which include simulated representations of automobiles. However, none have the particular combination of features of the present invention. Thus, a decorative mailbox solving the aforementioned problems is desired.

SUMMARY OF THE INVENTION

The decorative mailbox is of two-piece design, having a lower portion and an upper portion. The lower portion is a box-like receptacle adapted to receive and contain mail items therein. The upper portion is designed in the shape of a motor vehicle. The vehicle may be of any make and/or model. NASCAR vehicles, trucks, and sports cars may be desirable examples for the user. The upper portion is hinged to the lower portion at their respective rear ends in a manner that allows the upper portion to be pivoted upward. A ratchet mechanism allows the upper portion to remain stationary in at least two raised positions. A snap mechanism is disposed at the front ends of the two portions to retain the upper portion in closed position when desired.

Accordingly, the present invention provides a decorative mailbox in the form of an automotive vehicle, with the mailbox being provided with a mechanism that permits pivoted opening of the top portion and convenient stationary positioning of the top portion in at least two open positions. A second mechanism allows the mailbox to be securely retained in a closed position.

In an alternative embodiment, the decorative mailbox comprises a box having an open front end and a door pivotally attached to the lower portion of the open front end. The top of the mailbox includes a replica of a racecar, the front end of the car being mounted on the top portion of the door, forming a door handle. The door engages a front lip protruding from the front opening in order to retain the door of the mailbox in a closed position. A flag is attached to the box-shaped body of the mailbox, and may be decorated to simulate a checkered flag.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
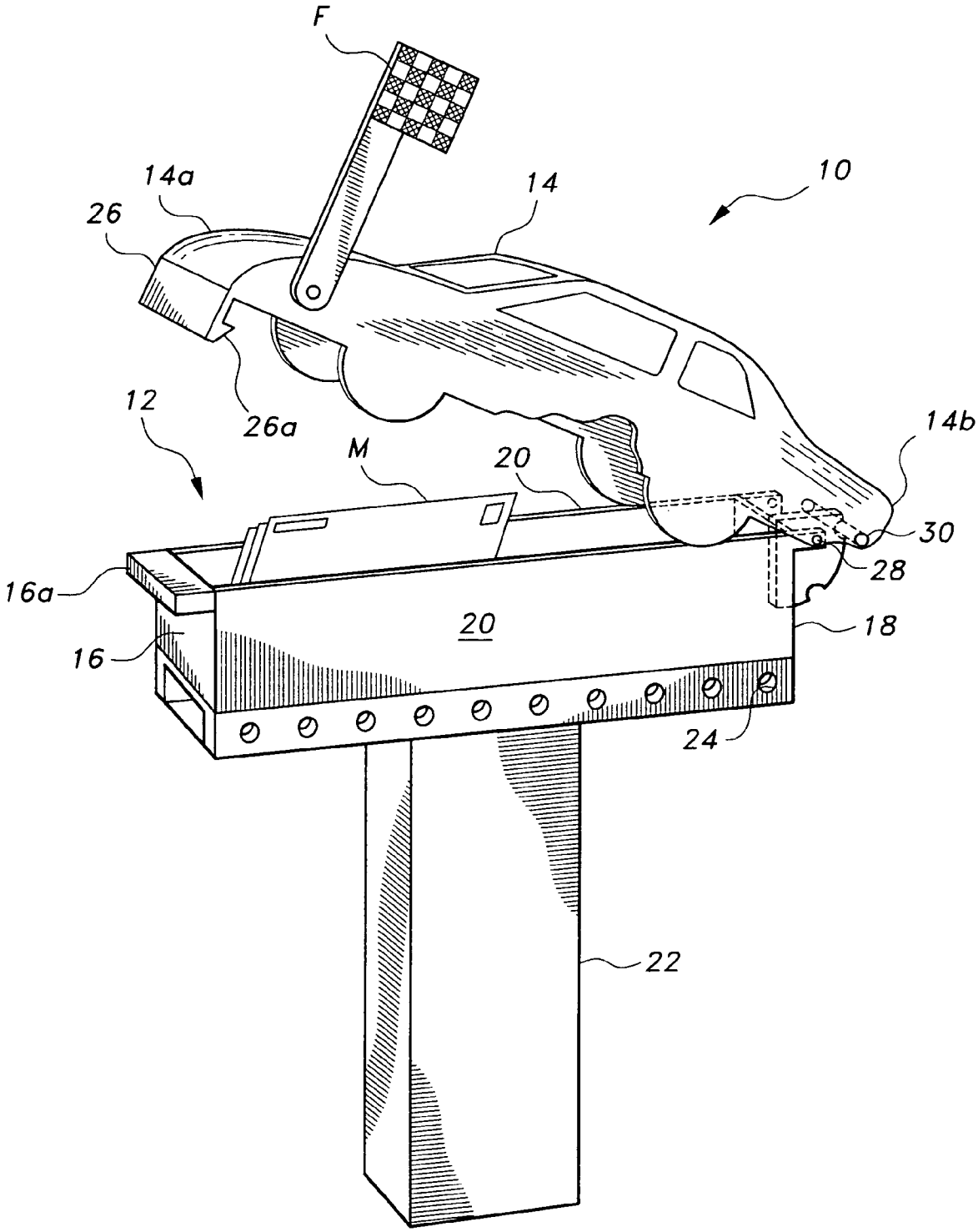
FIG. 1 is an environmental, perspective view of a decorative mailbox according to the present invention.
Figure 2:
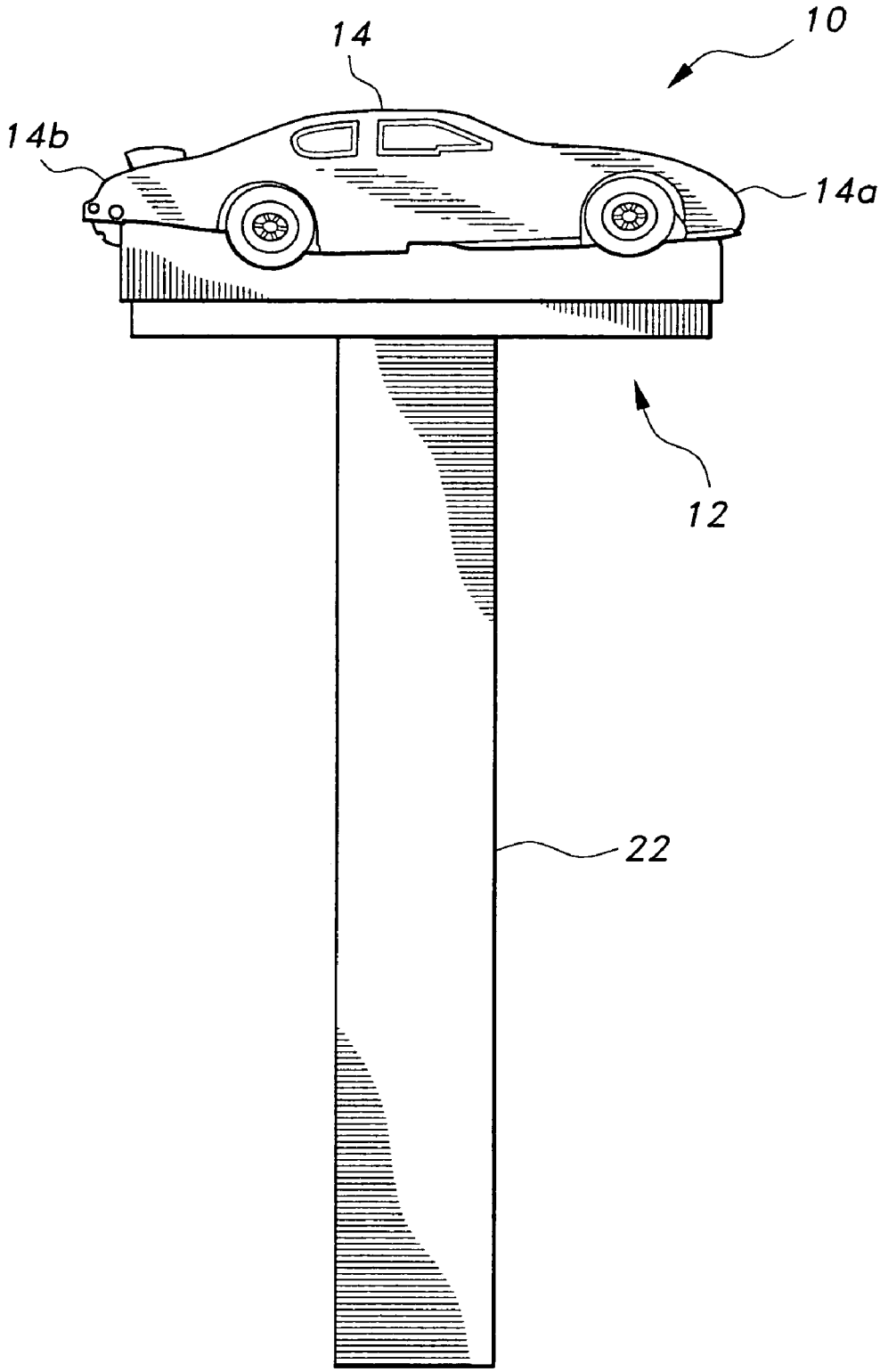
FIG. 2 is a side view of a decorative mailbox according to the present invention in a closed position.
Figure 3:
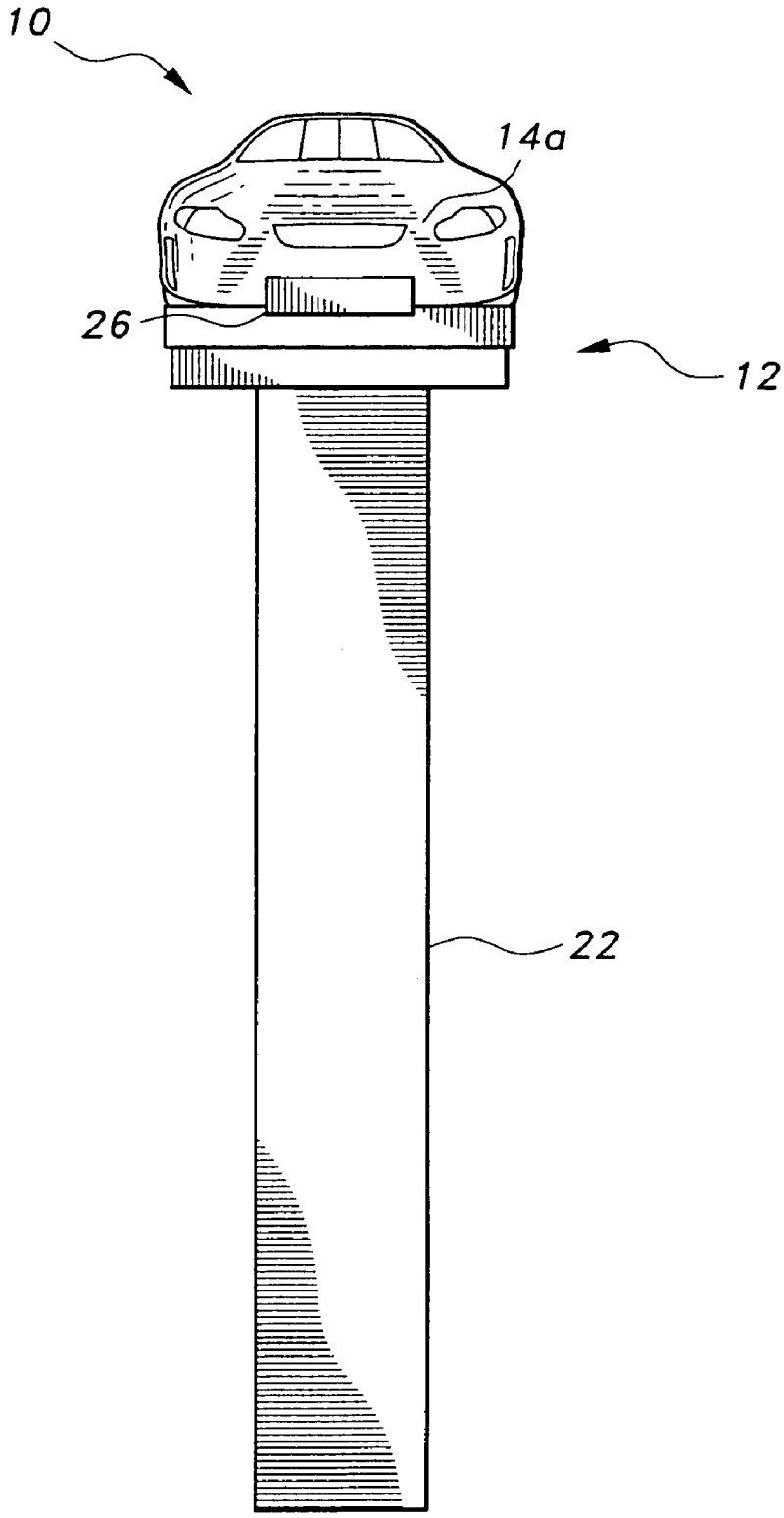
FIG. 3 is a front view of a decorative mailbox according to the present invention in the closed position.

Attention is first drawn to FIGS. 1–3 wherein a first embodiment of the decorative mailbox of the present invention is generally indicated at 10. The mailbox comprises a lower portion 12 and an upper portion 14. Lower portion 12 is an open-topped box having a front wall 16, a rear wall 18 and sidewalls 20. A lip 16*a* is disposed on the upper end of front wall 16. Lower portion 12 has an open interior region for receiving mail M and small packages therein. Lower portion 12 is adapted to be attached to a post 22. A series of mounting holes 24 is provided on sidewalls 20 to facilitate the attachment.

Upper portion 14 is configured as an automotive vehicle, the vehicle having a front end 14*a* and a rear end 14*b*. The upper portion 14 is pivotally attached to lower portion 12 by a pivot pin 28 extending through upper portion 14 and lower portion 12 at the rear end of the mailbox 12. As mentioned above, upper portion 14 may be designed to simulate any automotive vehicle. A simulated license plate 26 is disposed on front end 14*a*. A ledge 26*a* is provided on the inner surface of plate 26. When closed, ledge 26*a* engages lip 16*a* to retain the upper portion in closed position. A positioning rod 30 spans the rear end 14*b* and is attached thereto.

Figure 4:
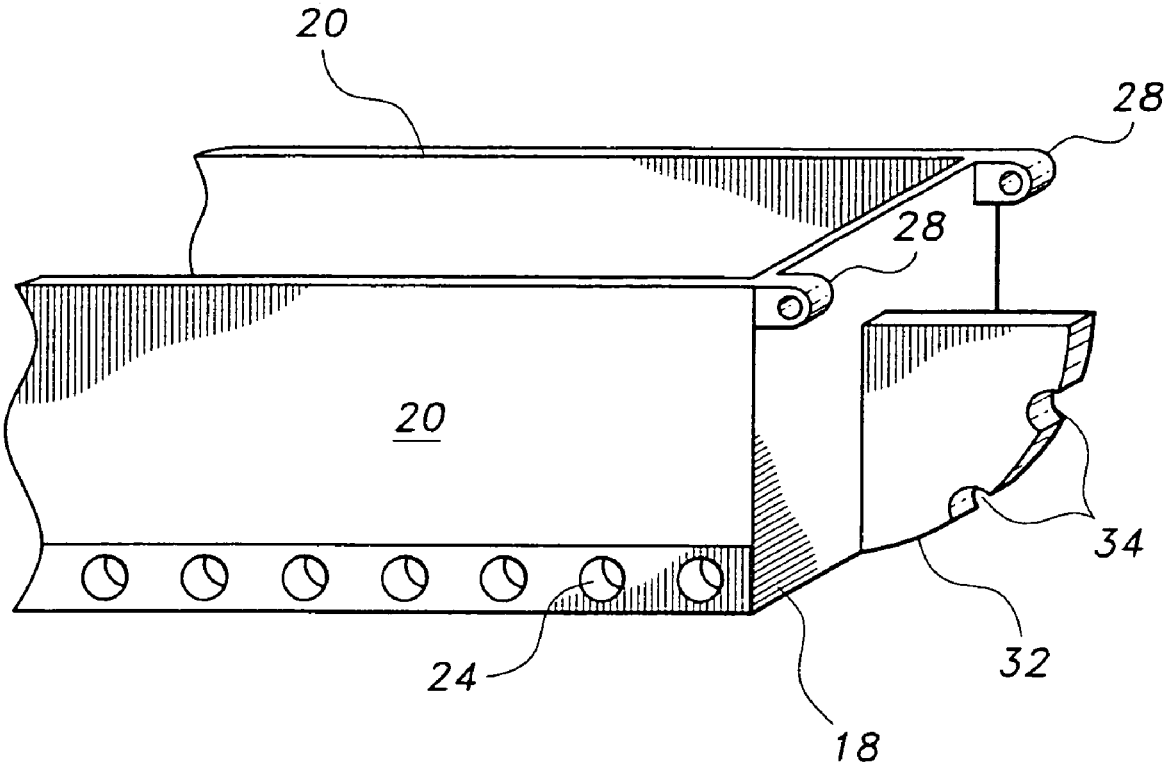
FIG. 4 is a partial, perspective view of the bottom rear portion of a decorative mailbox according to the present invention.

As best seen in FIG. 4, a positioning ratchet or retainer block or plate 32 is disposed on the rear wall 18. Positioning ratchet 32 is provided with at least two notches 34 for receiving positioning rod 30 therein. This allows the upper portion 14 to be secured in at least two raised positions. A simulated flag F, shown in FIG. 1, is pivotally mounted to the upper portion 14 for indicating when mail has been placed in the mailbox.

Figure 5:
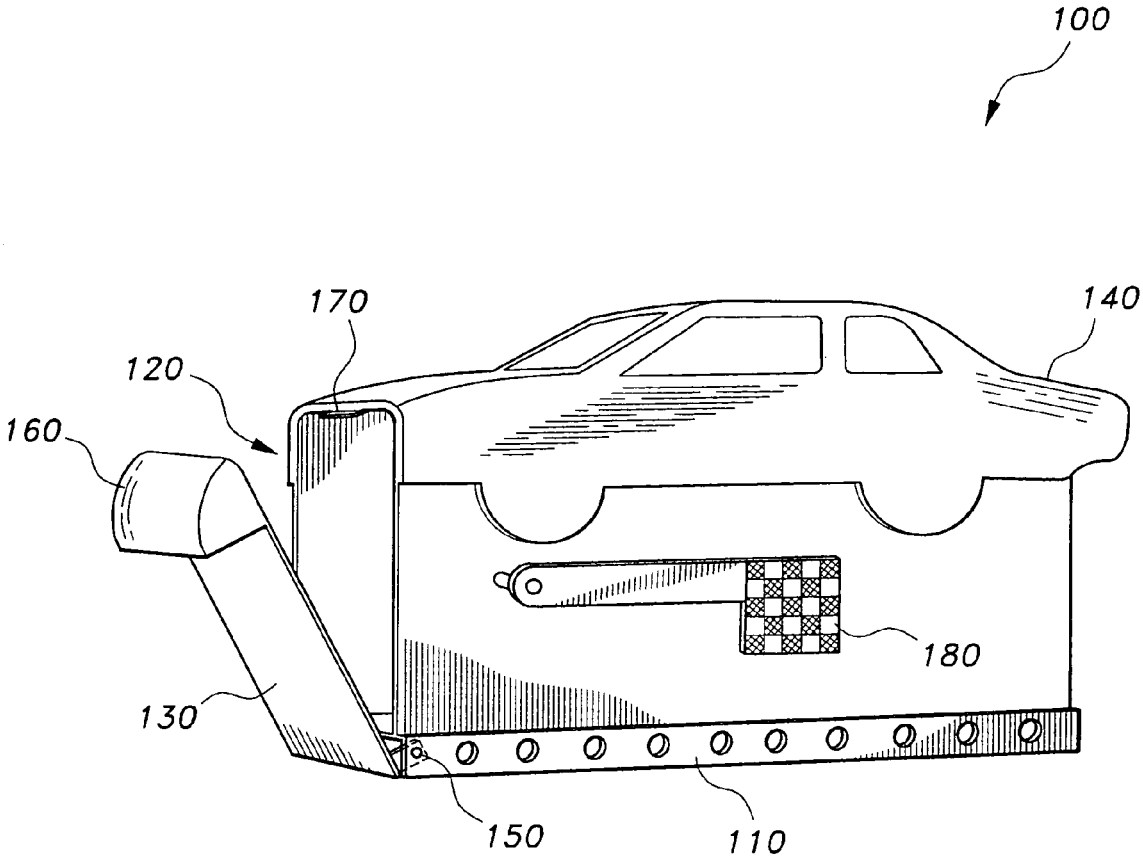
FIG. 5 is a perspective view of an alternative embodiment of a decorative mailbox according to the present invention.

In the alternative embodiment of FIG. 5, mailbox 100 includes an open housing 110 having an upper portion 140, which is shaped to simulate an automobile, such as a racecar, for example. Housing 110 has a front opening 120 for the insertion and removal of mail within housing 110. A door 130 is pivotally joined at its lower end to a lower edge of housing 110 by a hinge 150, allowing for the selective closing of opening 120. A protruding lip 170 is mounted on an upper edge of housing 110, adjacent opening 120. Lip 170 projects outwardly to releasably engage door 130, releasably securing door 130 to the periphery-defining opening 120 through frictional engagement.

A handle portion 160 is formed adjacent an upper edge of door 130, allowing the user to easily grasp and open door 130. Handle portion 160 is shaped to simulate the front end portion of the automobile 140, and may define a bottom recess so that the user can insert his or her fingers below the automobile front end portion forming handle portion 160 in order to open the mailbox door 130. Further, a flag 180 is pivotally attached to the outer surface of housing 110 to selectively indicate the reception of mail within mailbox 100. Flag 180 may be shaped and decorated to simulate an automobile racing "checkered flag".

It is to be understood that the present invention is not limited to the embodiment described above, but encompasses any and all embodiments within the scope of the following claims.

I claim:

1. A decorative mailbox, comprising:

a lower portion having a front wall, a rear wall, two opposing sidewalls, and a bottom wall joined to define a box-shaped enclosure having a top opening, the enclosure being dimensioned and configured for receiving mail;

an upper portion having a front end and a rear end, the upper portion being configured to simulate an automotive vehicle;

a pivot pin extending through the upper and lower portions, the pin pivotally attaching the upper portion to the lower portion adjacent the rear end, the upper portion pivoting between an open position leaving the top of the enclosure at least partially open, and a closed position covering the open top;

a positioning rod extending across the rear end of the upper portion; and a retainer block extending from the rear wall of the lower portion, the retainer block having a plurality of notches defined therein, the positioning rod releasably engaging the notches at selected angular positions in order to selectively retain the upper portion in the open position at a user-selectable angular position relative to the lower portion.

2. The decorative mailbox as recited in claim 1, further comprising a latching member disposed on and projecting downward from the front end of said upper portion.

3. The decorative mailbox as recited in claim 2, further comprising a lip extending from an upper end of the front wall of said lower portion, said latching member releasably engaging the lip in order to latch said upper portion in the closed position.

4. The decorative mailbox as recited in claim 1, wherein the opposing sidewalls of said lower portion have a plurality of mounting holes defined therein adapted for mounting said lower portion to a mailbox post.

5. The decorative mailbox as recited in claim 1, further comprising a mailbox flag pivotally mounted to said upper portion.

6. The decorative mailbox as recited in claim 5, further comprising indicia simulating a checkered racing flag disposed on said mailbox flag.

* * * * *